US007277655B2

(12) United States Patent
Namba

(10) Patent No.: US 7,277,655 B2
(45) Date of Patent: Oct. 2, 2007

(54) OPTICAL WRITING UNIT AND IMAGE FORMING APPARATUS HAVING AN OPTICAL SYSTEM CASING AND A CLEANING TOOL

(75) Inventor: Masanori Namba, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 11/169,683

(22) Filed: Jun. 30, 2005

(65) Prior Publication Data

US 2006/0001980 A1 Jan. 5, 2006

(30) Foreign Application Priority Data

Jun. 30, 2004 (JP) ..... 2004-194635
May 13, 2005 (JP) ..... 2005-140987

(51) Int. Cl.
*G03G 21/00* (2006.01)
*B41J 2/435* (2006.01)

(52) U.S. Cl. ..... 399/98; 347/224

(58) Field of Classification Search ..... 347/224; 399/98; 359/198, 649
See application file for complete search history.

(56) References Cited

U.S. PATENT DOCUMENTS 5,073,795 A 12/1991 Nukaya
6,308,024 B1 * 10/2001 Nakayama et al. ..... 399/98
2003/0053156 A1 3/2003 Satoh et al.
2004/0240905 A1 * 12/2004 Yamazaki ..... 399/98
2005/0012973 A1 * 1/2005 Sowa et al. ..... 359/198
2006/0001980 A1 1/2006 Namba

FOREIGN PATENT DOCUMENTS

| | | | |
|---|---|---|---|
| EP | 1 462 867 A1 | | 9/2004 |
| JP | 63075764 | * | 4/1988 |
| JP | 2002072368 | * | 3/2002 |
| JP | 2002131997 | * | 5/2002 |
| JP | 2002-267983 | | 9/2002 |
| JP | 2004017607 | * | 1/2004 |

OTHER PUBLICATIONS

U.S. Appl. No. 11/492,882, filed Jul. 26, 2006, Namba.

* cited by examiner

*Primary Examiner*—Hai Pham
*Assistant Examiner*—Carlos A. Martinez, Jr.
(74) *Attorney, Agent, or Firm*—Oblon, Spivak, McClelland, Maier & Neustadt, P.C.

(57) ABSTRACT

An optical writing unit for use in an image forming apparatus, wherein the optical writing unit includes an optical system which generates a light beam to write an electrostatic latent image on an image carrying member of the image forming apparatus, and a casing which encases the optical system. The casing includes an opening portion and a transparent member which externally seals the opening portion and has a top surface higher than a surface of the casing with a predetermined height and an optical writing area through which the light beam emits.

24 Claims, 11 Drawing Sheets

OPTICAL WRITING UNIT AND IMAGE FORMING APPARATUS HAVING AN OPTICAL SYSTEM CASING AND A CLEANING TOOL

This application claims priority from Japanese patent applications No. 2004-194635 filed on Jun. 30, 2004 and No. 2005-140987 filed on May 13, 2005 in the Japan Patent Office, the entire contents of which are hereby incorporated by reference herein.

BACKGROUND OF THE INVENTION

Field of the Invention

The following disclosure relates generally to an image forming apparatus and an optical writing unit configured to write an electrostatic latent image on an image carrying member with a light beam generated by an optical system.

DESCRIPTION OF THE INVENTION

Conventionally, an image forming apparatus such as a digital copier, a facsimile, or a printer has employed an optical writing unit to write an electrostatic latent image on a surface of an image carrying member (i.e., photoconductive member) by scanning a light beam, deflected by an optical system such as polygon mirror, on the surface of the image carrying member, wherein the light beam is modulated based on image signals and deflected by an optical system such as polygon mirror, mirrors, and lenses in the optical writing unit.

An increased demand on a miniaturization of the image forming apparatus leads to a variety of arrangements of the optical writing unit in an image forming apparatus. For example, the optical writing unit may be arranged in a horizontal direction with respect to the image carrying member, or may be arranged in a downward direction with respect to the image carrying member. In such an image forming apparatus, deposits such as dust, developing agents or toner may stick on a dust-proof glass provided for a light-beam emitting port of the optical writing unit, and may block a passage of the light beam, thereby resulting in a degradation of image quality.

Particularly, if polymerized toners are used for the image forming apparatus, spattered polymerized toners may more likely adhere and stick to components in the image forming apparatus compared to pulverized toners. In the background art a detachable dust-proof cover over the dust-proof glass has been used for the light-beam emitting port of the optical writing unit so that deposits such as dust do not stick on the dust-proof glass.

If the deposits such as dust stick to the dust-proof glass, the dust-proof cover may be detached in order to clean the dust-proof glass. The dust-proof glass may be cleaned with a cleaning unit having a cleaning pad, which may be provided with the image forming apparatus. However, the above-mentioned background art requires a space around the dust-proof cover and the dust-proof glass to accommodate the detachable dust-proof cover. The required space affects the ability to miniaturize the image forming apparatus.

Furthermore, deposits such as dust and spattered toners, which evade the dust-proof cover, may stick on the dust-proof glass. Consequently, a cleaning operation on the dust-proof glass may be required.

In addition to the above-mentioned situation, because of an increasing demand of high volume printing in a shorter timer, high speed printing, or the like, a heat-effect in image forming apparatus has become an issue for designing a configuration of the image forming apparatus. Specifically, a temperature increase in the image forming apparatus may affect a performance of the optical unit. If such temperature increase affects the optical unit, the image forming apparatus for producing color image may produce a color image print having lower image quality such as color displacement.

In order to reduce the above-mentioned drawback caused by the temperature increase, some image forming apparatuses have been employing a configuration providing a fixing unit in an upper part of the image forming apparatus so that a heat generated in the fixing unit may less likely have an affect on other units such as an optical unit and an image forming unit in the image forming apparatus.

Such a configuration may provide the optical unit under the image forming unit. Consequently, the optical unit conducts scanning to a photoconductive member in a upward-direction. Therefore, a dust-proof glass provided on the optical unit may also come under the image forming unit. Therefore, deposits such as dust and spattered toners may more likely adhere to the dust-proof glass, and may not drop from the dust-proof glass. If polymerized toners having spherical shape adhere to the dust-proof glass, a cleaning operation of the dust-proof glass may become more difficult.

SUMMARY OF THE INVENTION

Accordingly, the present disclosure relates, accordingly to at least one embodiment of the present invention, to an optical writing unit for use in an image forming apparatus. The optical writing unit includes an optical system which generates a light beam to write an electrostatic latent image on an image carrying member of the image forming apparatus, and a casing which encases the optical system. The casing includes an opening portion and a transparent member. The transparent member externally seals the opening portion and has a top surface higher than a surface of the casing with a predetermined height and an optical writing area through which the light beam emits.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF THE EMBODIMENTS

Figure 1:
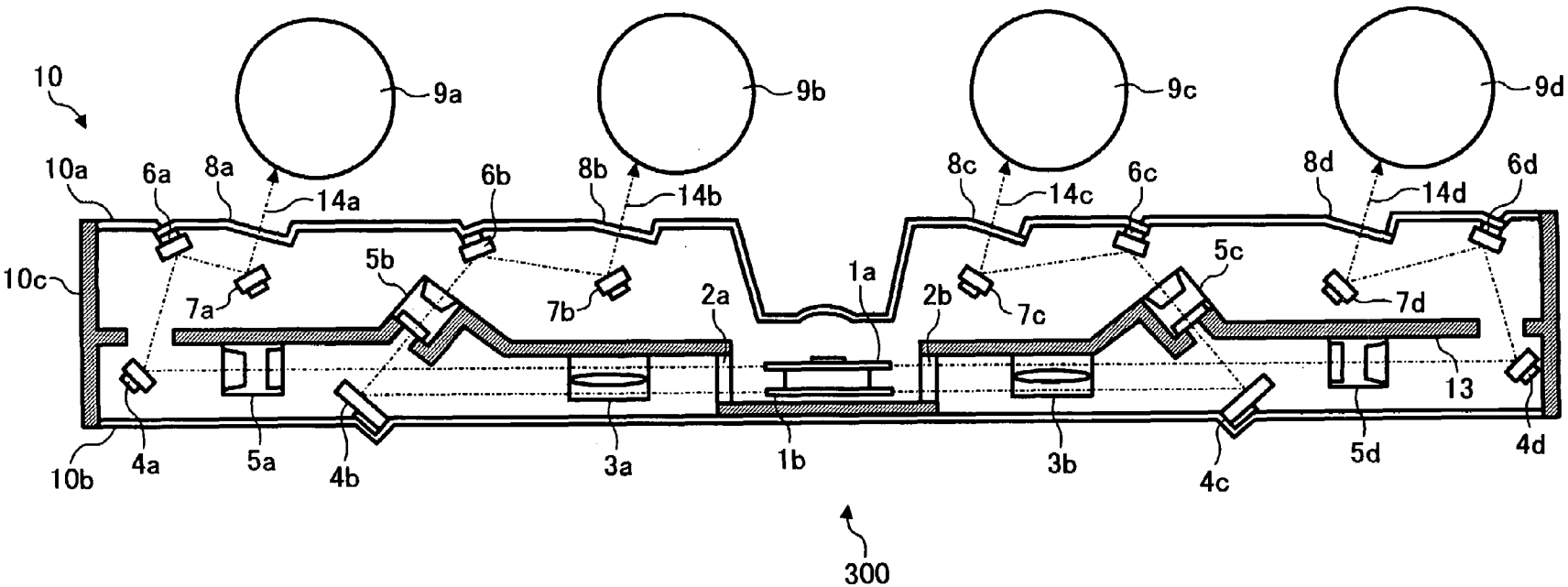
FIG. 1 is a schematic view of an optical writing unit and photoconductive drums of an image forming apparatus according to an example embodiment.

In describing example embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

Figure 2:
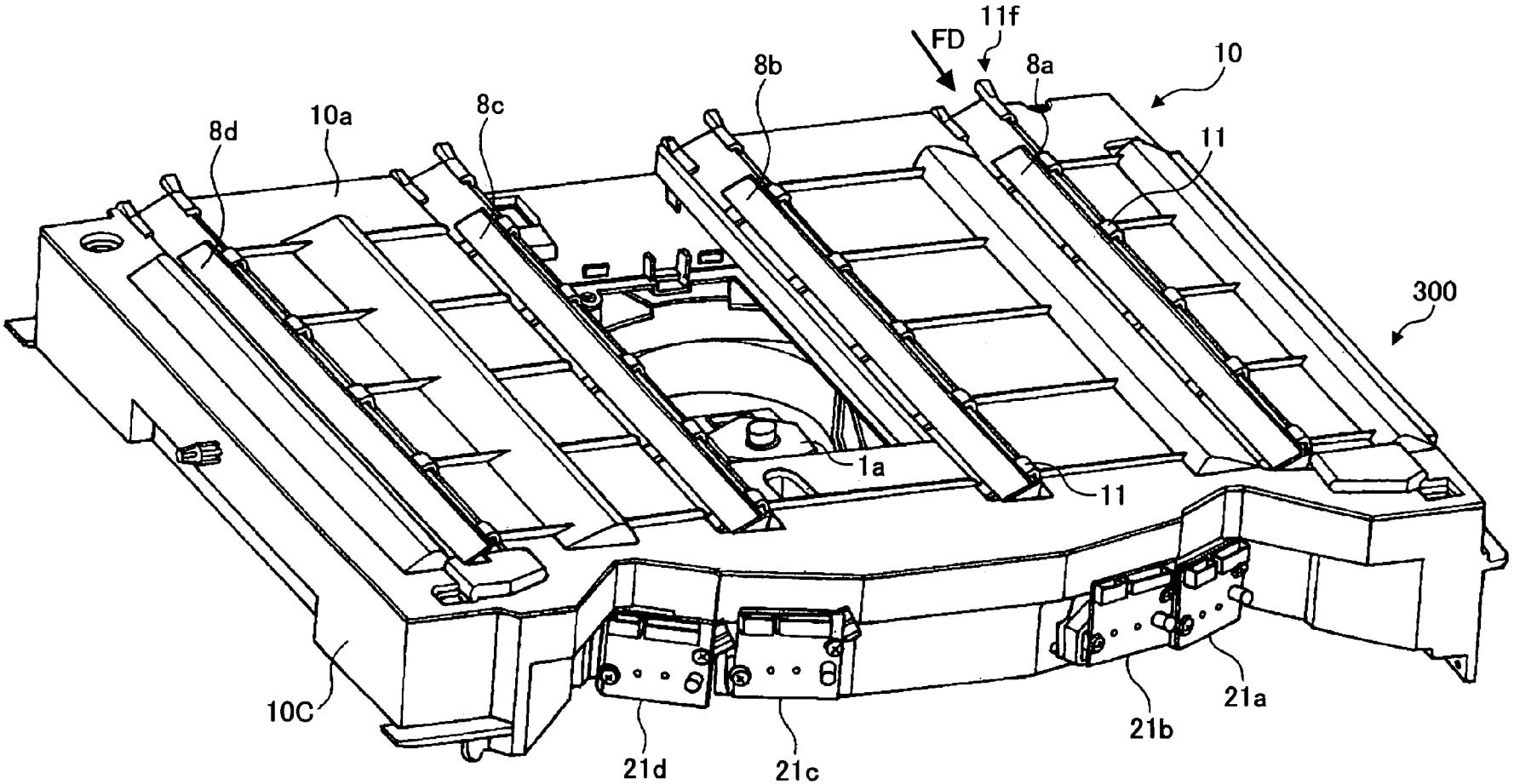
FIG. 2 is a schematic perspective view of an optical writing unit in FIG. 1.

Referring now to the drawings, wherein like reference numerals designate identical or corresponding parts throughout the several views, and more particularly to FIGS. 1 and 2 thereof, an optical writing unit 300 of an image forming apparatus according to an example embodiment of the present invention is described.

The optical writing unit 300 shown in FIG. 1 can be used in an image forming apparatus having a tandem configuration which arranges a plurality of image carrying members (i.e., photoconductive drums 9*a*, 9*b*, 9*c*, and 9*d*) side by side for producing a full color image.

The optical writing unit 300 can be arranged under the photoconductive drums 9*a*, 9*b*, 9*c*, and 9*d* as shown in FIG. 1, for example.

Each of the photoconductive drums 9*a*, 9*b*, 9*c*, and 9*d* forms a yellow image, a magenta image, a cyan image, and a black image, respectively, wherein a positional sequence of photoconductive drums 9*a*, 9*b*, 9*c*, and 9*d* is changeable.

Although not shown in FIG. 1, each of the photoconductive drums 9*a*, 9*b*, 9*c*, and 9*d* is surrounded with a plurality of known components used for image forming conducted by an electro-photocopying method.

As shown in FIGS. 1 and 2, the optical writing unit 300 includes light-source units 21*a*, 21*b*, 21*c*, and 21*d*, polygon mirrors 1*a* and 1*b*, f-theta lenses 3*a* and 3*b*, focus lenses 5*a*, 5*b*, 5*c*, and 5*d*, and reflecting mirrors 4*a*, 4*b*, 4*c*, 4*d*, 6*a*, 6*b*, 6*c*, 6*d*, 7*a*, 7*b*, 7*c*, and 7*d*, and a casing 10.

Each of the light-source units 21*a*, 21*b*, 21*c*, and 21*d* includes a laser diode, for example.

The casing 10 includes an upper wall 10*a*, a bottom wall 10*b*, and a side wall 10*c*.

The polygon mirrors 1*a* and 1*b* deflect each of light beams coming from the light-source units 21*a*, 21*b*, 21*c*, and 21*d* to two directions as shown in FIG. 1.

The f-theta lenses 3*a* and 3*b*, and the focus lenses 5*a*, 5*b*, 5*c*, and 5*d* are provided in symmetrical positions with respect to the polygon mirrors 1*a* and 1*b*.

The f-theta lenses 3*a* and 3*b*, and the focus lenses 5*a*, 5*b*, 5*c*, and 5*d* guide light beams deflected by the polygon mirrors 1*a* and 1*b* to a surface of each of the photoconductive drums 9*a*, 9*b*, 9*c*, and 9*d* via the reflecting mirrors 4*a*, 4*b*, 4*c*, 4*d*, 6*a*, 6*b*, 6*c*, 6*d*, 7*a*, 7*b*, 7*c*, and 7*d* as shown in FIG. 1.

As shown in FIG. 1, the casing 10 includes the upper wall 10*a*, the bottom wall 10*b*, and the side wall 10*c*, and contains a support plate 13 therein.

The support plate 13 is provided in a middle of the casing 10 so that the support plate 13 divides an inner space of the casing 10 as shown in FIG. 1.

As shown in FIG. 2, the light-source units 21*a*, 21*b*, 21*c*, and 21*d* are provided to the side wall 10*c*.

As shown in FIGS. 1 and 2, the polygon mirrors 1*a* and 1*b* are provided to a substantially center position of the support plate 13 (i.e., concaved portion).

As shown in FIG. 1, the f-theta lenses 3*a* and 3*b*, focus lenses 5*a*, 5*b*, 5*c*, and 5*d*, and reflecting mirrors 4*a*, 4*b*, 4*c*, 4*d*, 6*a*, 6*b*, 6*c*, 6*d*, 7*a*, 7*b*, 7*c*, and 7*d* are provided to the upper wall 10*a*, side wall 10*c*, bottom wall 10*b*, and the support plate 13.

Because the casing 10 has the upper wall 10*a*, the side wall 10*c*, and the bottom wall 10*b*, four openings 31*a*, 31*b*, 31*c*, and 31*d* are provided on the upper wall 10*a* to cause the light beams to pass therethrough to the photoconductive drums 9*a*, 9*b*, 9*c*, and 9*d*.

Each of the openings 31*a*, 31*b*, 31*c*, and 31*d* is sealed by dust-proof glasses 8*a*, 8*b*, 8*c*, and 8*d*, respectively.

The optical writing unit 300 receives image data (e.g., primary color signals) from an input-unit such as document reader (not shown), personal computer (not shown), word processor (not shown), or facsimile (not shown), in which primary color image data is generated from image information.

Such image data is converted to light-source driving signals, and each of the light-source units 21*a*, 21*b*, 21*c*, and 21*d* emits a respective light beam based on the light-source driving signals.

The light beams deflect symmetrically with respect to the polygon mirror 1*a* and 1*b*. That is, two light beams are deflected in a first direction, and another two light beams are deflected in a second direction, which is symmetrical to the first direction as shown in FIG. 1.

FIG. 1 shows a configuration providing two polygon mirrors (i.e., polygon mirrors 1*a* and 1*b*) in a double-decked manner, in which the polygon mirror 1*a* deflects light beams 14*a* and 14*d* for scanning the photoconductive drum 9*a* and 9*d*, and the polygon mirror 1*b* deflects light beams 14*b* and 14*c* for scanning the photoconductive drums 9*b* and 9*c*.

Although FIG. 1 shows a configuration providing two polygon mirrors (i.e., polygon mirrors 1*a* and 1*b*) in a double-decked manner, one polygon mirror having a larger thickness which can deflect four light beams can be used for scanning the photoconductive drums 9*a*, 9*b*, 9*c*, and 9*d*, for example.

As shown in FIG. 1, the light beams 14*a* and 14*d* deflected at the polygon mirror 1*a* pass through the f-theta lenses 3*a* and 3*b*, reflect at the first reflection mirrors 4*a* and 4*d*, pass through the focus lenses 5*a* and 5*d*, reflect at the second reflection mirrors 6*a* and 6*d*, further reflect at the third reflection mirrors 7*a* and 7*d*, pass through the dust-proof glass 8*a* and 8*d*, and then scan photoconductive drums 9*a* and 9*d*, respectively.

As also shown in FIG. 1, the light beams 14*b* and 14*c* deflected at the polygon mirrors 1*b* pass through the f-theta lenses 3*a* and 3*b*, reflect at the first reflection mirrors 4*b* and 4*c*, pass through the focus lenses 5*b* and 5*c*, reflect at the second reflection mirrors 6*b* and 6*c*, further reflect at the third reflection mirrors 7*b* and 7*c*, pass through the dust-proof glass 8*b* and 8*c*, and then scan photoconductive drums 9*b* and 9*c*, respectively.

With such a scanning operation, an electrostatic latent image is formed on each surface of the photoconductive drums 9*a*, 9*b*, 9*c* and 9*d*.

Figure 3:
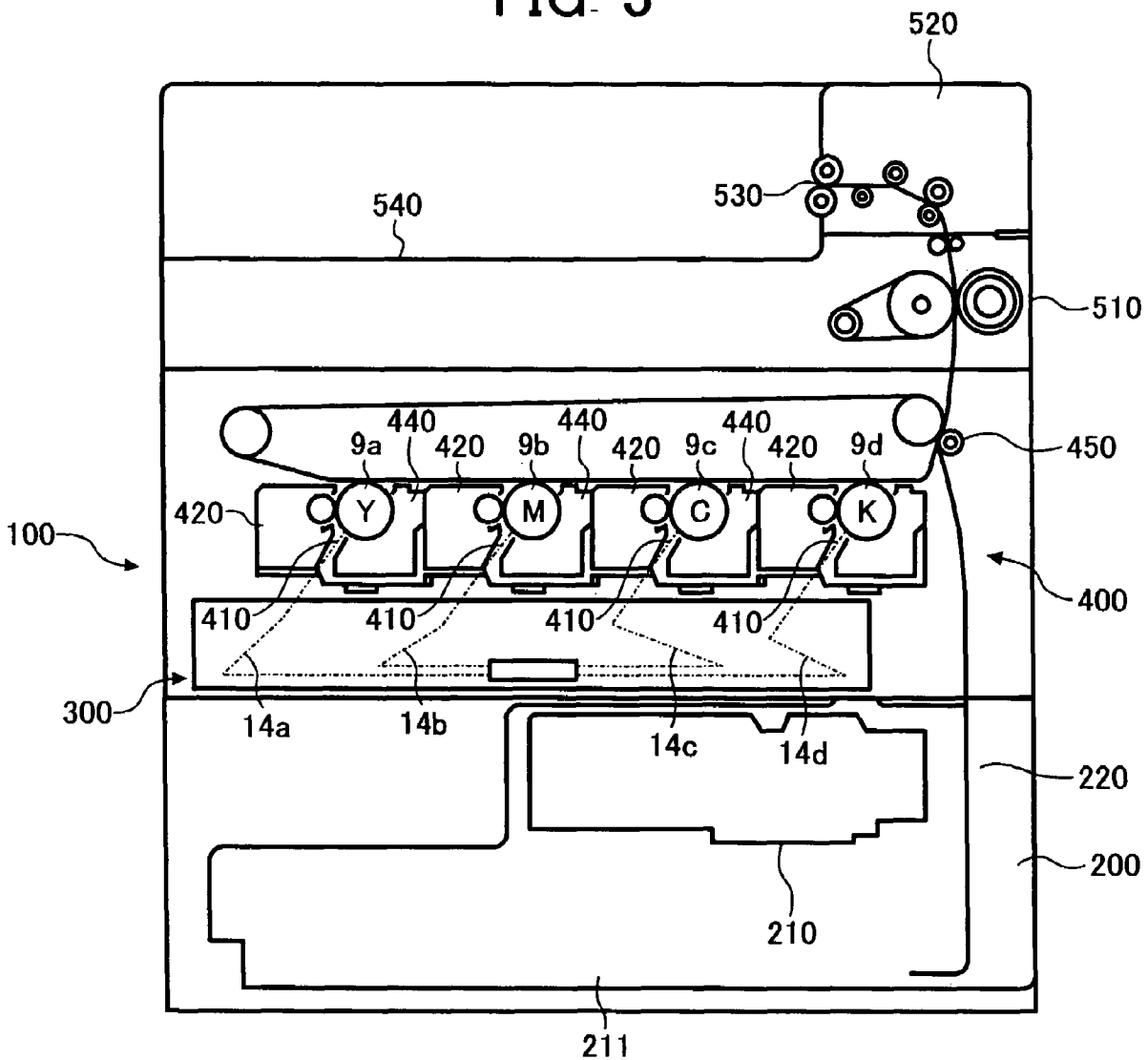
FIG. 3 is a schematic view of an image forming apparatus having an optical writing unit in FIG. 1.

FIG. 3 is a schematic view of image forming apparatus having an optical writing unit shown in FIGS. 1 and 2.

Figure 4:
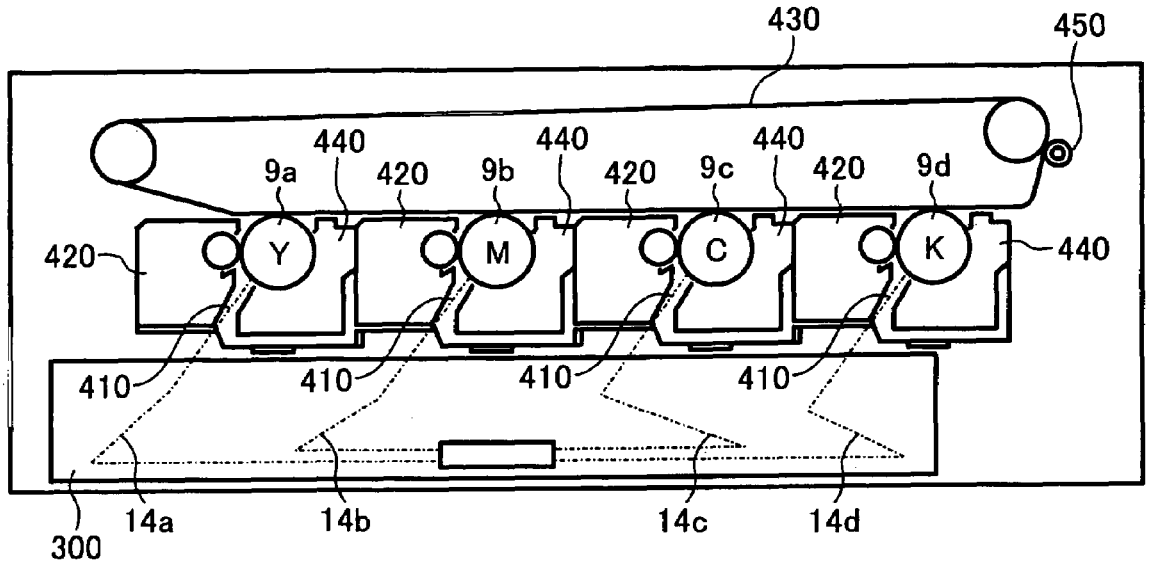
FIG. 4 is a schematic view explaining a relationship of an optical writing unit, an image forming unit, and a transfer belt of an image forming apparatus according to an example embodiment.

FIG. 4 is a schematic view explaining a relationship of an optical writing unit, an image forming unit, and a transfer belt of an image forming apparatus according to an example embodiment.

As shown in FIG. 3, an image forming apparatus 100 includes a sheet-feed unit 200, the optical writing unit 300, an image forming unit 400, and a fixing unit 510.

Specifically, the sheet-feed unit 200, the optical writing unit 300, the image forming unit 400, and the fixing unit 510 are provided from the bottom portion to the upper-most portion of the image forming apparatus 100 as shown in FIG. 3.

The sheet-feed unit 200 includes sheet cassettes 210 and 211. A sheet is picked up from the sheet cassettes 210 or 211 by a sheet-feed roller (not shown), and transported to the image forming unit 400 through a transport line 220.

In the image forming unit 400, the electrostatic latent image written on each of the photoconductive drums 9*a*, 9*b*, 9*c*, and 9*d* by the optical writing unit 300 is developed as a toner image and transferred to a sheet.

As shown in FIG. 4, the image forming unit 400 includes the photoconductive drum 9*a*, 9*b*, 9*c*, and 9*d*, and other components provided around the photoconductive drums 9*a*, 9*b*, 9*c*, and 9*d* for image forming.

Specifically, the image forming unit 400 includes a charging unit (not shown) having a charger such as charge roller and charge brush, an exposing part 410, a developing unit 420, a intermediate transfer belt 430, a drum-cleaning unit (not shown), a de-charger for the photoconductive drums 9*a*, 9*b*, 9*c*, and 9*d*.

At the exposing part 410, the light beam emitted from the optical writing unit 300 exposes the photoconductive drums 9*a*, 9*b*, 9*c*, and 9*d*.

The developing unit 420 is used to develop a yellow image, a magenta image, a cyan image, a black image on each of the photoconductive drums 9*a*, 9*b*, 9*c*, and 9*d*.

Toner images developed on the photoconductive drums 9*a*, 9*b*, 9*c*, and 9*d* are transferred to the intermediate transfer belt 430.

The drum-cleaning unit (not shown) removes toners remaining on the photoconductive drums 9*a*, 9*b*, 9*c*, and 9*d*, and the de-charger de-charges the photoconductive drums 9*a*, 9*b*, 9*c*, and 9*d* for a subsequent image forming process.

In an example embodiment of the present invention, the charger, the drum-cleaning unit, the de-charger and the photoconductive drum may be integrated as a photoconductive unit 440.

The developing unit 420 and the photoconductive unit 440 are detachably provided in the image forming apparatus 100.

The toner images transferred to the intermediate transfer belt 430 are further transferred to the sheet, transported from the sheet-feed unit 200, at a transfer position 450.

Then the sheet is fed to the fixing unit 510 to fix the toner images on the sheet.

After the fixing, the sheet is ejected to an ejection tray 540 from an ejection port 530 of an ejection unit 520.

In addition, after transferring the toner image to the sheet at the transfer position 450, toners remaining on the intermediate transfer belt 430 are removed by a belt-cleaning unit (not shown) provided in the image forming unit 400.

Figure 5:
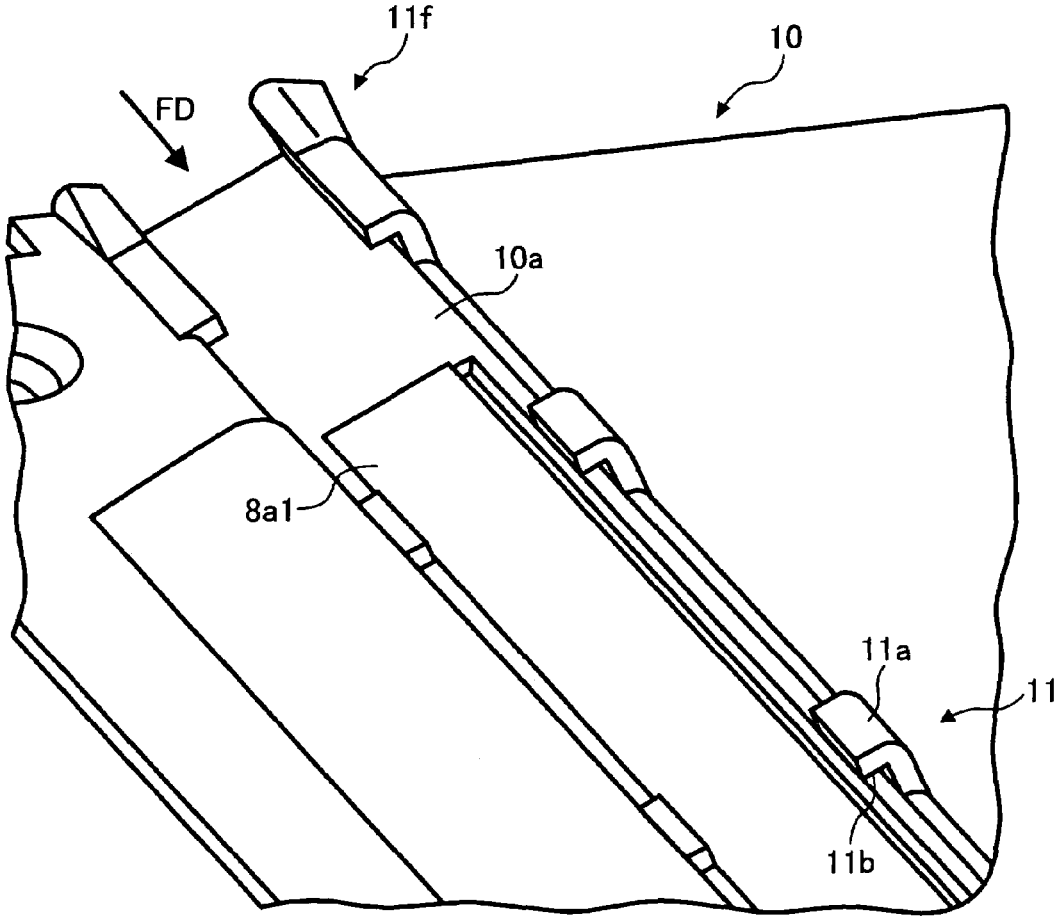
FIG. 5 is a partial view of a dust-proof glass provided for an optical writing unit in FIG. 2.

FIG. 5 is a partial view of the dust-proof glass 8*a* on the upper wall 10*a* of the optical writing unit 300.

Although not shown in FIG. 5, the dust-proof glasses 8*b*, 8*c*, and 8*d* are similarly attached on the upper wall 10*a* of the optical writing unit 300.

As show in FIG. 6, the dust-proof glass 8*a* externally seals the opening 31*a* formed on the upper wall 10*a* from an outer side of the casing 10, wherein the light beam 14*a* passes through the opening 31*a* and the dust-proof glass 8*a*.

The dust-proof glass 8*a* is provided over the opening 31*a* by attaching peripheral portions of the dust-proof glass 8*a* to an area surrounding the opening 31*a*.

For example, a double-sided adhesive tape is attached to the peripheral portions of the dust-proof glass 8*a* at first, and then the peripheral portions of the dust-proof glass 8*a* is attached to the area surrounding the opening 31*a*.

Figure 6A:
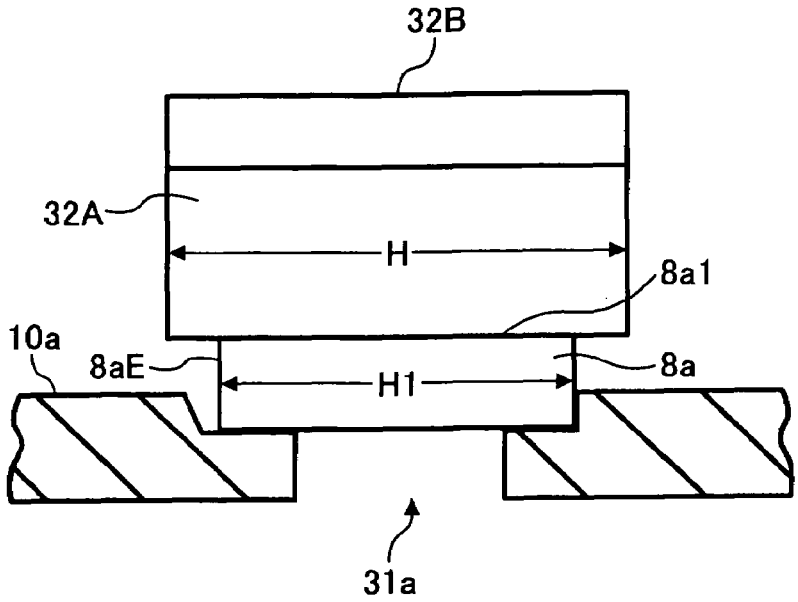
FIG. 6A is a schematic view explaining a relationship of a dust-proof glass of an optical writing unit, a casing of an optical writing unit, and a cleaning member, wherein a width of the cleaning member is larger than a width of the dust-proof glass.

As shown in FIG. 6A, a recessed area surrounding the opening 31*a* is provided on the upper wall 10, and the dust-proof glass 8*a* is attached to such recessed area.

A depth of the recessed area and a thickness of the dust-proof glass 8*a* is adjusted so that a top surface 8*a*1 of the dust-proof glass 8*a* can protrude from a surface of the upper wall 10*a* as shown in FIG. 6A.

Therefore, a cleaning tool 32 (see FIG. 7A) having a cleaning member 32A can contact the top surface 8*a*1 of the dust-proof glass 8*a* without an interference of the upper wall 10*a*, and the cleaning tool 32 can remove deposits (e.g., toner powders and dust) on the top surface 8*a*1 of the dust-proof glass 8*a* without an interference of the upper wall 10*a*.

Figure 7A:
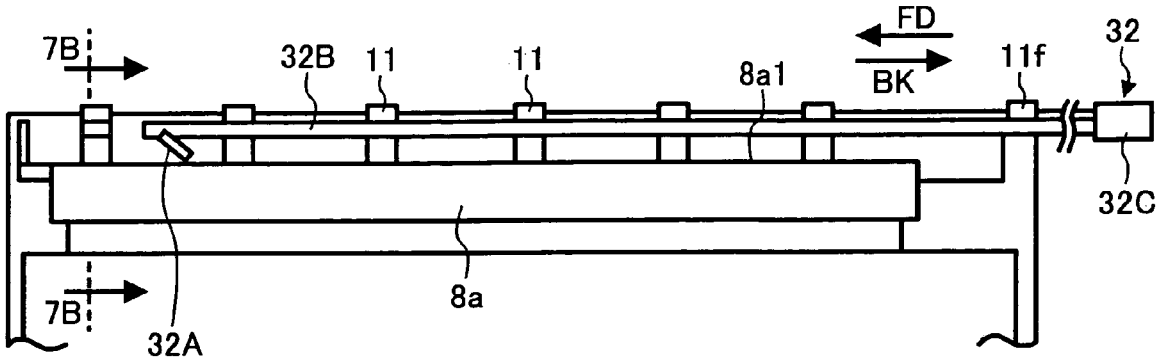
FIG. 7A is a schematic view explaining a relationship of a cleaning tool, a casing of an optical writing unit, and a dust-proof glass of an optical writing unit of an image forming apparatus according to an example embodiment.

As shown in FIG. 7A, the cleaning tool 32 includes a cleaning member 32A, a support member 32B, and a handling part 32C.

As shown in FIG. 7A, the cleaning member 32A is attached to one end portion of the support member 32B having a longer plate shape, and the handling part 32C is attached to other end portion of the support member 32B.

Figure 12:
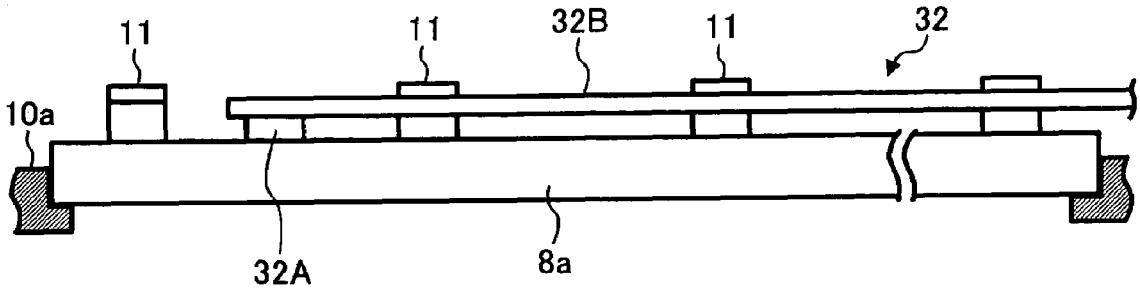
FIG. 12 is a schematic view explaining a relationship of another cleaning tool, a casing of an optical writing unit, and a dust-proof glass of an optical writing unit of an image forming apparatus.

The cleaning member 32A includes a blade type (shown in FIG. 7A), a brush type, felt type, or a sponge type (shown in FIG. 12), for example.

Preferably, the cleaning member 32A employs a blade type formed of a synthetic resin (e.g., polyurethane rubber), which is also used for a photoconductive member and intermediate transfer belt. An effective cleaning operation on the top surface 8*a*1 can be obtained by cleaning the top surface 8*a*1 using an edge 32Ae of the cleaning member 32A. Hereinafter, a cleaning operation using the cleaning member 32A having a blade type is explained in detail.

Figure 6B:
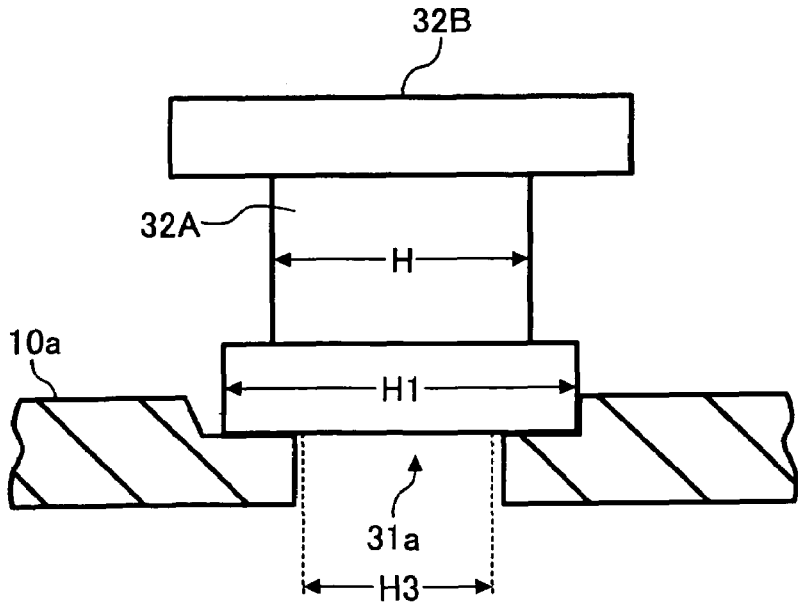
FIG. 6B is a schematic view explaining a relationship of a dust-proof glass of an optical writing unit, a casing of an optical writing unit, and a cleaning member, wherein a width of the cleaning member is smaller than a width of the dust-proof glass.

As shown in FIGS. 6A and 6B, a width of the cleaning member 32A is defined as "H," a width of the dust-proof glass 8*a* is defined as "H1," and a width required for passing through a laser beam is defined as "H3."

As shown in FIG. 6A, "H" can be adjusted to a width which can clean an entire surface of the dust-proof glass 8*a*. Such conditions can be defined as below from FIG. 6A.

$$H \geqq H1$$

As shown in FIG. 6B, "H" can be adjusted to a width, which can cover an area required for passing through a laser beam on the dust-proof glass 8*a*.

In this case, "H" can be set as a smaller value than "H1" because the cleaning member 32A can effectively clean the top surface 8*a*1 with a width of "H3."

Therefore, "H" can be set as below:

$$H3 \leqq H \leqq H1$$

It is preferable that "H" of the cleaning member 32A is set to the above-range of "H 3≦H≦H1" because the edge 8*a*E of the dust-proof glass 8*a* does not interfere with the cleaning member 32A when cleaning the dust-proof glass 8*a* if "H" of the cleaning member 32A is set to the above-range of"H3≦H≦H1". Consequently, the cleaning member 32A will likely not receive damage from the edge 8*a*E of the dust-proof glass 8*a*.

As show in FIG. 5 and FIG. 7A, a plurality of guide members 11 are provided along a longitudinal direction and a side area of the dust-proof glass 8*a* on the upper wall 10*a*. The plurality of guide members 11 are provided on the upper wall 10*a* with an equal interval between adjacent guide members 11, for example, to guide the cleaning tool 32.

As shown in FIG. 5, each of the guide members 11 includes a pair of guide pieces.

An edge portion 11*a* of the guide piece is extended over the dust-proof glass 8*a* while the edge portion 11*a* is parallel to the top surface 8*a*1 of the dust-proof glass 8*a*.

Figure 7B:
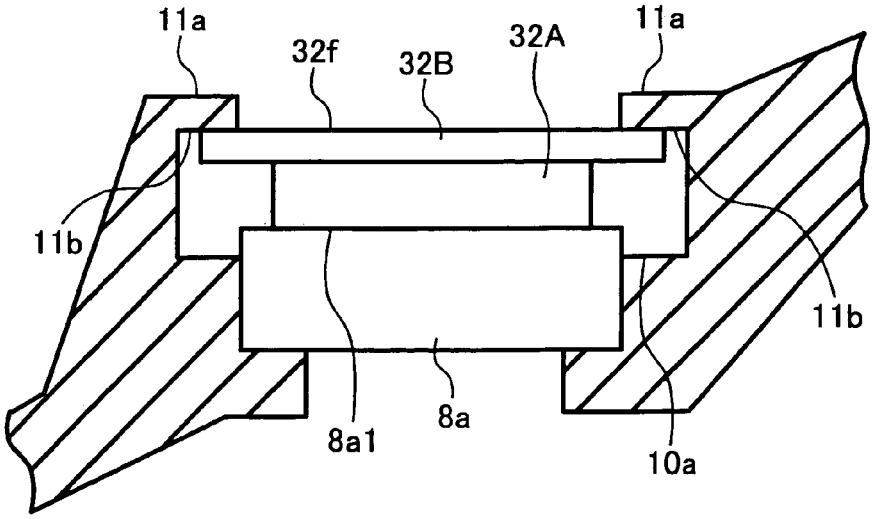
FIG. 7B is a schematic cross-sectional view at the line 7B-7B in FIG. 7A.

FIG. 7B show a cross-sectional view at the line 7B-7B in FIG. 7A.

As shown in FIG. 7B, the edge portion 11*a* of the guide piece includes a face 11*b*, which faces the dust-proof glass 8*a*.

As shown in FIG. 7B, the face 11*b* of the edge portion 11*a* contacts a face 32*f* of the support member 32B of the cleaning tool 32.

The guide members 11 hold the support member 32B while the cleaning tool 32 conducts a cleaning operation, and guide the support member 32B when moving the cleaning tool 32 in a longitudinal direction of the dust-proof glass 8*a*.

When cleaning the dust-proof glass 8*a*, the cleaning tool 32 is inserted from a guide member 11*f*, which is provided to a front side of the optical writing unit 300 as shown in FIG. 5.

The cleaning member 32A of the cleaning tool 32 is inserted from the guide member 11*f* in the arrow direction "FD" as shown in FIG. 7A.

Figure 8:
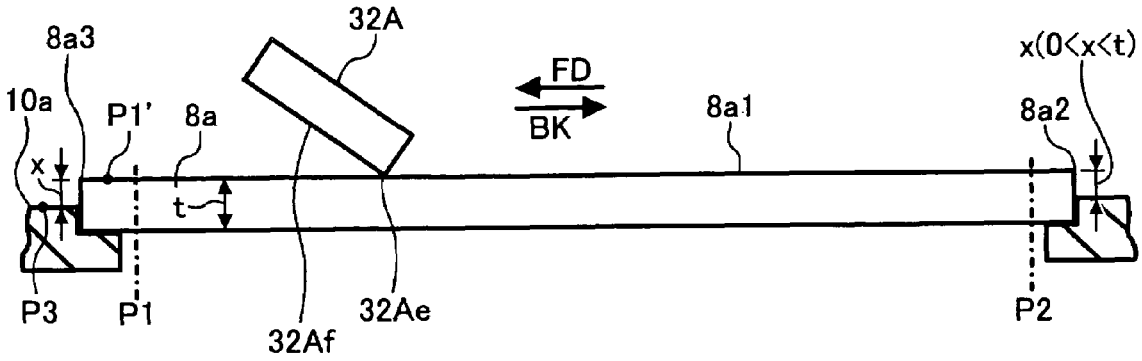
FIG. 8 is a schematic view explaining a positional relationship of a dust-proof glass, a casing of an optical writing unit, and a cleaning member.

At first, as shown in FIG. 8, the cleaning member 32A is moved to a point P1', which is located between an edge 8*a*3 of the dust-proof glass 8*a* and a point P1. The point P1 and a point P2 shown in FIG. 8 define an optical writing area, through which the light beam emits. Then, the cleaning member 32A is moved from the point P1' in an arrow direction "BK" to remove deposits (e.g., toner powders and dust) on the top surface 8*a*1 of the dust-proof glass 8*a*.

When inserting the cleaning tool 32 from the arrow direction "FD", the cleaning member 32A goes over the edge 8*a*2 of the dust-proof glass 8*a*. At this time, a face 32Af of the cleaning member 32A contacts the surface of the dust-proof glass 8*a* as shown in FIG. 8, and deforms elastically. Consequently the cleaning member 32A may perform an effective deposit-removing operation. However, because of such elasticity of the cleaning member 32A, the cleaning member 32A receives little damage when the cleaning member 32A goes over the edge 8*a*2 of the dust-proof glass 8*a*.

When the cleaning member 32A is moved in the arrow direction "BK," an edge 32Ae of the cleaning member 32A functions as a scraper. The edge 32Ae of the cleaning member 32A contacts the top surface 8*a*1 of the dust-proof glass 8*a*, and removes deposits (e.g., toner powders and dust) on the top surface 8*a*1 of the dust-proof glass 8*a* so that an effective cleaning operation can be favorably conducted. Consequently, the arrow direction "BK" becomes a direction for the cleaning operation on the top surface 8*a*1 of the dust-proof glass 8*a*.

When moving the cleaning member 32A in the arrow direction "FD," the guide member 11*f* may function as a positional regulator which regulates a moving range of the cleaning tool 32 so that the cleaning member 32A does not reach the upper wall 10*a* by passing over the edge 8*a*3 of the dust-proof glass 8*a* shown in FIG. 8. With such regulation, the edge 32Ae of the cleaning member 32A can be moved from the point P1' in the arrow direction "BK." Consequently, the edge 32Ae of the cleaning member 32A does not run on the edge 8*a*3 of the dust-proof glass 8*a*, and the edge 32Ae of the cleaning member 32A does not receive damages from the edge 8*a*3 of the dust-proof glass 8*a*. Accordingly, the cleaning member 32A can be used in a stable condition over a longer period.

The above-mentioned operations of the cleaning tool 32 can be conducted by moving the handling part 32C of the cleaning tool 32 in the directions "FD" and "BK." During the insertion of the cleaning tool 32 in the direction "FD," the cleaning member 32A may remove deposits (e.g., toner powders and dust) adhered to the top surface 8*a*1 of the dust-proof glass 8*a*.

These deposits (e.g., toner powders and dust) are pushed over the point P1 shown in FIG. 8, and may be pushed over on the upper wall 10*a*. Consequently, such deposits may not remain on the optical writing area defined by the point P1 and P2 shown in FIG. 8. Accordingly, a cleaning may be conducted during the insertion of the cleaning tool 32 in the direction "FD."

Furthermore, the top surface 8*a*1 of the dust-proof glass 8*a* can be flush with a surface of the upper wall 10*a*, or the top surface 8*a*1 of the dust-proof glass 8*a* can be below the surface of the upper wall 10*a*. However, if the top surface 8*a*1 of the dust-proof glass 8*a* is below the surface of the upper wall 10*a*, the cleaning member 32A may not securely contact the top surface 8*a*1 of the dust-proof glass 8*a*.

For example, the cleaning member 32A may contact at one area on the top surface 8*a*1 of the dust-proof glass 8*a*, but may not contact at another area on the top surface 8*a*1 of the dust-proof glass 8*a*. If such an unstable contacting condition occurs, a cleaning operation by the cleaning member 32A may reduce its cleaning effectiveness.

In view of such background, in an example embodiment of the present invention, the top surface 8*a*1 of the dust-proof glass 8*a* protrudes from the surface of the upper wall

Figure 9:
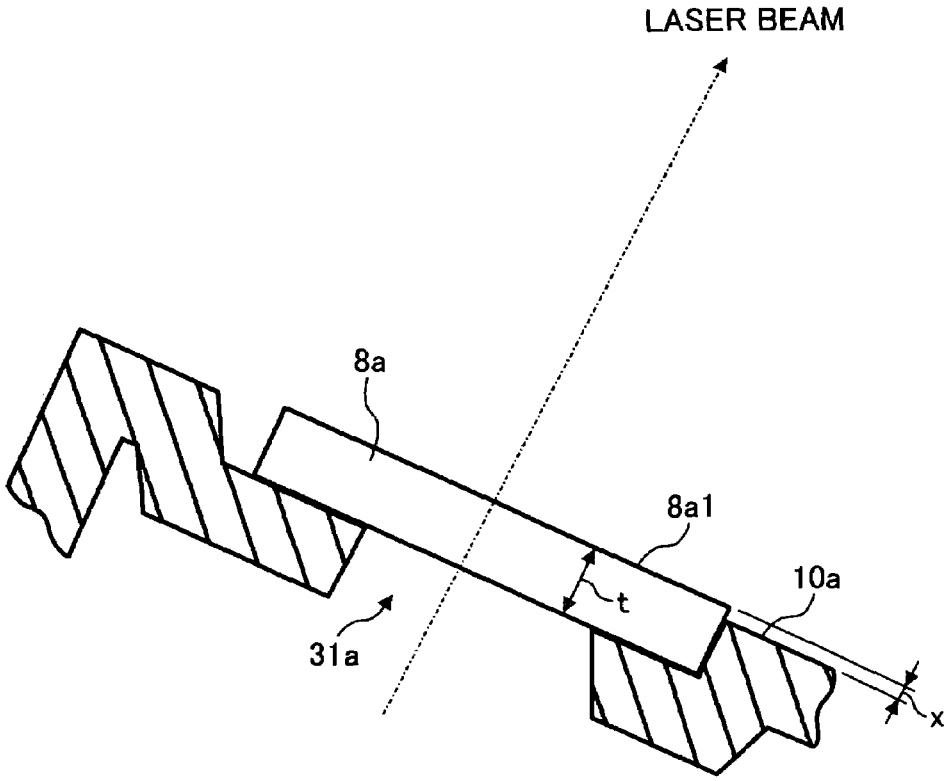
FIG. 9 is a schematic view explaining a relationship of thickness of a dust-proof glass with respect to a casing of an optical writing unit.

10*a* with a predetermined protruding height "X" as shown in FIGS. 8 and 9. With such arrangement, the edge 32Ae of the cleaning member 32A contacts closely with the top surface 8*a*1 of the dust-proof glass 8. Consequently, the cleaning member 32A can effectively conduct a cleaning operation on the top surface 8*a*1 of the dust-proof glass 8*a*.

However, if the predetermined protruding height "X" becomes too large, the top surface 8*a*1 of the dust-proof glass 8*a* protrudes more and more from the surface of the upper wall 10*a*. In such a case, the guide members 11 need to protrude more and more from the surface of the upper wall 10*a*, and such guide members 11 may interfere with other components. Therefore, in order to prevent interferences between components, the predetermined protruding height "X" of the dust-proof glass 8*a* is defined as below and as shown in FIG. 9.

$$0<X<t$$

wherein "t" is a thickness of the dust-proof glass 8*a*.

Specifically, the thickness "t" of the dust-proof glass 8*a* is preferably set from 1 to 3 mm, and more preferably about 2 mm, and the predetermined protruding height "X" of the dust-proof glass 8*a* is preferably set to about 0.5 mm, for example.

Assume a case that a point P3 is set to a outer side of the edge 8*a*3 of the dust-proof glass 8*a* as shown in FIG. 8 and the cleaning member 32A is moved in the arrow direction "BK" from the point P3. In this case, the edge 32Ae of the cleaning member 32A contacts the edge 8*a*3 of the dust-proof glass 8*a* when the cleaning member 32A is moved in the arrow direction "BK" from the point P3. Consequently, the edge 32Ae of the cleaning member 32A may be damaged at the edge 8*a*3 of the dust-proof glass 8*a*.

In order to prevent such a drawback, the surface of the upper wall 10*a* having the point P3 can be made flush with the top surface 8*a*1 of the dust-proof glass 8*a* or can be protruded from the top surface 8*a*1 of the dust-proof glass 8*a*.

Figure 10:
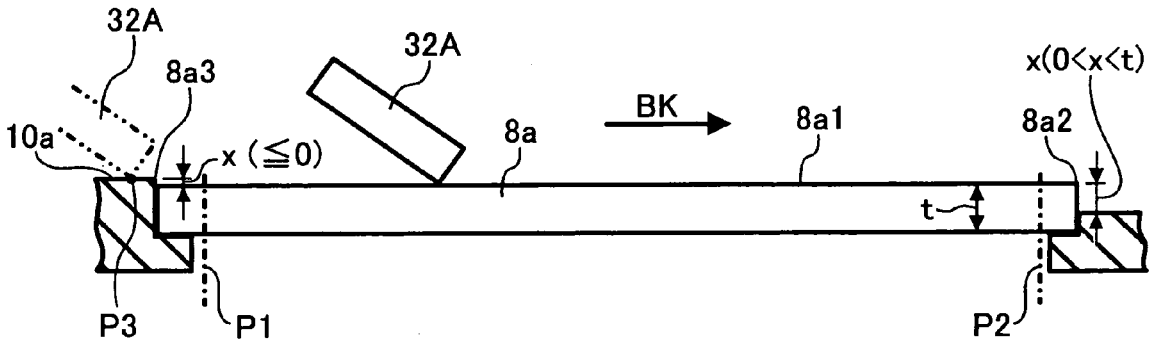
FIG. 10 is another schematic side view explaining a positional relationship of a dust-proof glass, a casing of an optical writing unit, and a cleaning member.

Therefore, as shown in FIG. 10, the predetermined protruding height "X" of the dust-proof glass 8*a* and the surface of the upper wall 10*a* having the point P3 is set to a following relationship at one side of the dust-proof glass 8*a* which faces the surface of the upper wall 10*a* having the point P3.

$$X \leqq 0$$

Under a configuration shown in FIG. 10, when the cleaning member 32A is moved on the top surface 8*a*1 of the dust-proof glass 8*a* in the arrow direction "FD" by passing over the edge 8*a*2 of the dust-proof glass 8*a*, the cleaning member 32A deforms elastically and contacts the edge 8*a*2 of the dust-proof glass 8*a* with the face 32Af of the cleaning member 32A. Consequently, the cleaning member 32A receives little damage when passing over the edge 8*a*2 of the dust-proof glass 8*a*.

In addition, under a configuration shown in FIG. 10 and the condition of "X≦0" at one side of the dust-proof glass 8*a* which faces the surface of the upper wall 10*a* having the point P3, when the cleaning member 32A is moved from the point P3 in the arrow direction "BK" for cleaning the top surface 8*a*1 of the dust-proof glass 8*a*, the edge 32Ae of the cleaning member 32A does not contact the edge 8*a*3 of the dust-proof glass 8*a*. Consequently, the edge 32Ae of the cleaning member 32A does not receive damage from the edge 8*a*3 of the dust-proof glass 8*a*.

Furthermore, the cleaning member 32A can remove deposits (e.g., toner powders and dust) from the top surface 8*a*1 of the dust-proof glass 8*a* effectively because the top surface 8*a*1 of the dust-proof glass 8*a* protrudes from the surface of the upper wall 10*a* in a cleaning area of the top surface 8*a*1 of the dust-proof glass 8*a*.

Figure 11:
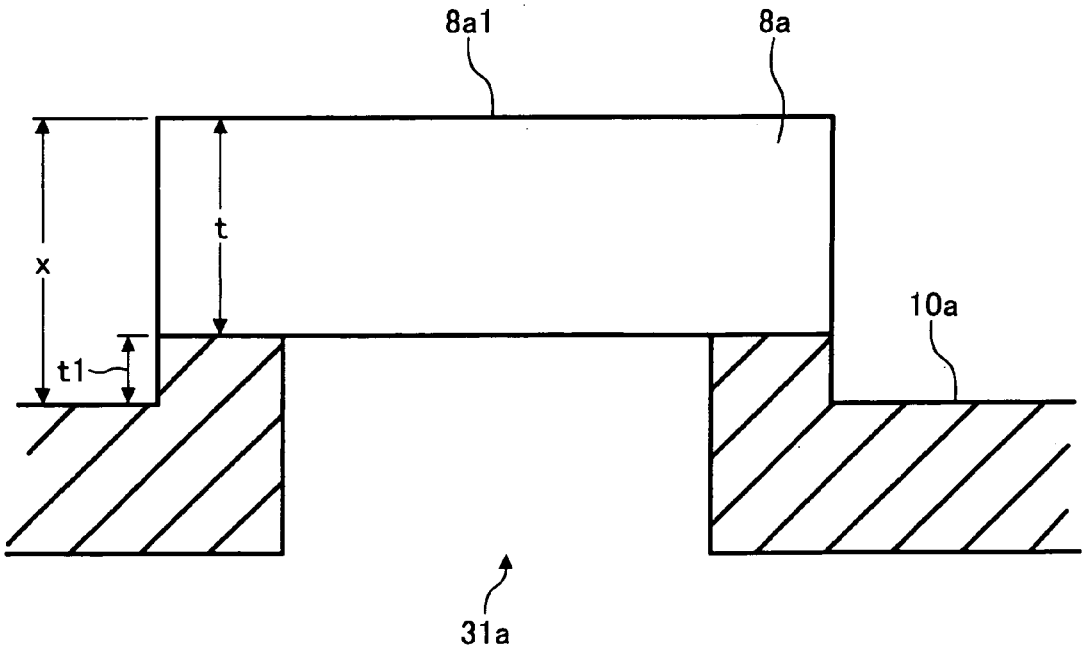
FIG. 11 is another schematic view explaining a relationship of thickness of a dust-proof glass with respect to a casing of an optical writing unit.

FIG. 11 shows another case where the dust-proof glass 8*a* is provided on the upper wall 10*a* without providing the above-mentioned recessed area, which is different from a configuration having the recessed area shown in FIG. 9.

As shown in FIG. 11, the dust-proof glass 8*a* having a predetermined thickness of "t" can be provided on the casing 10 by providing an attachment area having a predetermined height of "t1" from the surface of the upper wall 10*a* of the casing 10. Consequently, the top surface of the dust-proof glass 8*a* protrudes from the surface of the upper wall 10*a* with a protruding amount of "X" as shown in FIG. 11.

Although not shown in FIG. 11, the dust-proof glass 8*a* may be provided on the attachment area with an adhesive material such as double-sided tape. In such a case, the adhesive material such as the double-sided tape exists between the dust-proof glass 8*a* and the attachment area.

Because the attachment area has a predetermined height as shown in FIG. 11, a relationship "t1>0" may be set. In the above-described example embodiment, the top surface 8*a*1 of the dust-proof glass 8*a* protrudes from the surface of the upper wall 10*a* of the casing 10. Therefore, deposits (e.g., toner powders and dust) removed by the cleaning tool 32 will not remain on the top surface 8*a*1 of the dust-proof glass 8*a*, and an effective cleaning can be conducted. Such an effective cleaning operation can be conducted for the optical writing unit 300 of an example embodiment of the present invention, in which the dust-proof glass 8*a* faces the image forming unit 400 in an upward-direction in the image forming apparatus.

As above-described, the top surface 8*a*1 of the dust-proof glass 8*a* protrudes from the surface of the upper wall 10*a* with the predetermined protruding height "X" having the following relationship.

$$0<X<t$$

wherein "t" is a thickness of the dust-proof glass 8*a*. With such a condition, a displacement of the dust-proof glass 8*a* can be prevented during a cleaning operation conducted by the cleaning member 32A on the dust-proof glass 8*a* because the dust-proof glass 8*a* can be attached in the recessed area.

In the above-described example embodiment, explanations are given only to the dust-proof glass 8*a*. However, other dust-proof glasses 8*b*, 8*c*, and 8*d* can take a similar configuration as the dust-proof glass 8*a*. Therefore, the above-described explanations can be also applied to the dust-proof glasses 8*b*, 8*c*, and 8*d*.

When the cleaning tool 32 is not-in-use, the cleaning tool 32 can be held in a holder (not shown) provided in the image forming apparatus 100 shown in FIG. 3. Specifically, such a holder (not shown) can be provided inside a body of the image forming apparatus 100. For example, the holder can be provided in an inside-panel (e.g., front panel or side panel) of the image forming apparatus 100 so that the holder can hold the cleaning tool 32 when not-in-use. When a user determines that a cleaning operation is needed on the dust-proof glasses 8*a*, 8*b*, 8*c*, and 8*d*, the user can detach the cleaning tool 32 from the holder and conduct the cleaning operation on the dust-proof glasses 8*a*, 8*b*, 8*c*, and 8*d* with the cleaning tool 32.

Figure 13A:
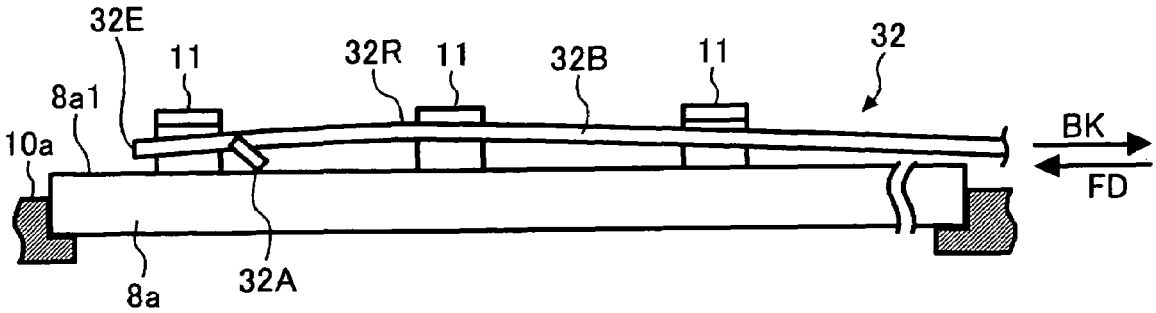
FIGS. 13A, 13B, and 13C show a cleaning operation of a dust-proof glass using a cleaning tool having an inflection portion.
Figure 13B:
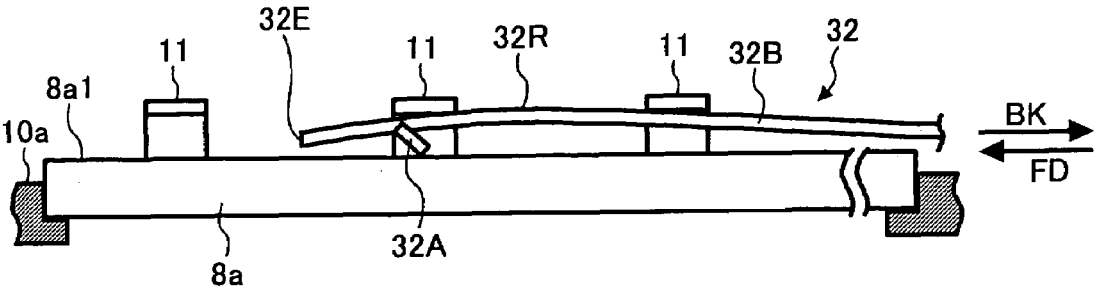
Figure 13C:
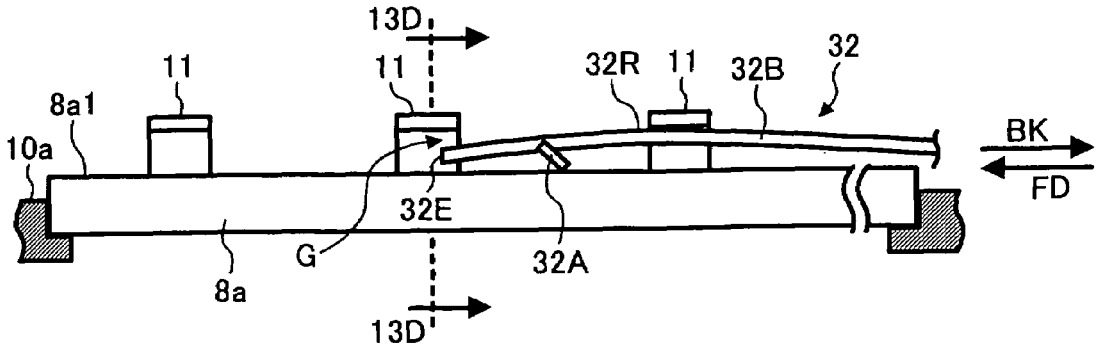

FIGS. 13A, 13B, and 13C show a cleaning operation of a dust-proof glass using another cleaning tool 32 according to another example embodiment.

Figure 13D:
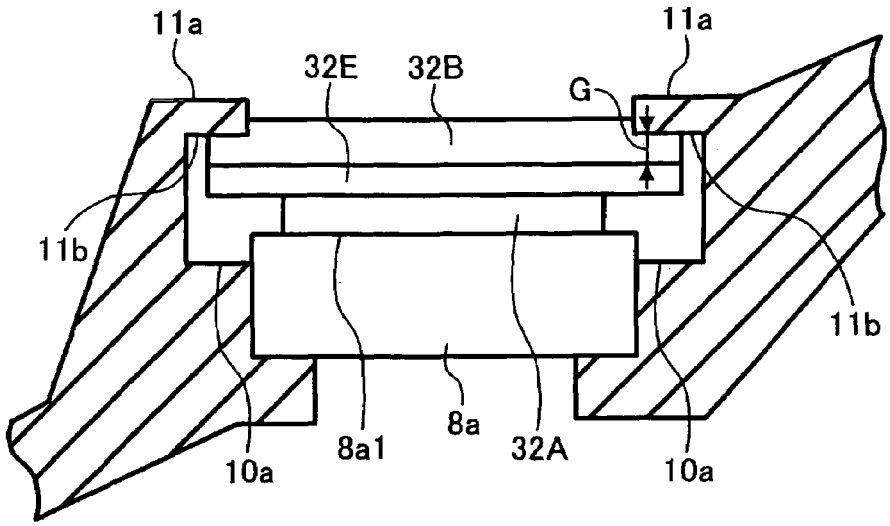
FIG. 13D is a schematic cross-sectional view at the line 13D-13D in FIG. 13C.

FIG. 13D is a schematic cross-sectional view at the line 13D-13D in FIG. 13C.

Because this example embodiment employs a similar configuration as in the above-described example embodiment except for the cleaning tool 32, similar components are identified with the same reference characters and descriptions regarding their functionality are omitted from the following description.

The cleaning tool 32 according to the example embodiment shown in FIGS. 13A to 13C includes the cleaning member 32A of a blade type, and the support member 32B which has an inflection portion 32R on a part of the support member 32B. The inflection portion 32R can be provided at a position which is closer to the cleaning 32A as shown in FIG. 13A to 13C. The inflection portion 32R has a convex-shape with respect to the dust-proof glass 8*a*. The inflection portion 32R can prevent warping of the support member 32B in an upward-direction with an elasticity of the support member 32B.

If the cleaning tool 32 includes the support member 32B having no inflection portion 32R, the face 32*f* of the support member 32B may contact the guide members 11 entirely. Under such a contacting condition, whenever an edge 32E of the support member 32B passes through the guide members 11 while cleaning the dust-proof glass 8*a*, the edge 32E of the support member 32B may warp in an upward direction due to an elasticity of the support member 32B. If such warping occurs at the edge 32E of the support member 32B, a contact pressure of the cleaning member 32A to the top surface 8*a*1 of the dust-proof glass 8*a* may not be maintained at a stable level, and such a condition may lead to a degradation of cleaning effectiveness.

In another example embodiment, the support member 32B includes the inflection portion 32R provided thereon as shown in FIGS. 13A, 13B, 13C, 13D, and the cleaning tool 32 is moved in the arrow direction "BK" for cleaning the dust-proof glass 8*a*.

In such a configuration, a position of the inflection portion 32R on the support member 32B, a gradient of inflection, and an interval of adjacent guide members 11 are determined so that at least one of the guide members 11 contacts the face 32*f* of the support member 32B as shown in FIG. 13A, for example. Moreover, at least one of the guide members 11 may be located at a position nearest to the cleaning member 32A in the direction of "BK," for example.

FIG. 13D is a schematic cross-sectional view at the line 13D-13D in FIG. 13C. As shown in FIG. 13D, a gap "G" exists between the edge 32E of the support member 32B and the plurality of guide members 11. Consequently, the edge 32E of the support member 32B is contact free with respect to the plurality of guide members 11.

In a configuration shown in FIGS. 13A to 13D, at least one of the guide members 11 applies a holding action to the support member 32B. Consequently, the warping of the edge 32E of the support member 32B can be suppressed. Furthermore, when the support member 32B includes the inflection portion 32R and the edge 32E which does not contact the guide members 11 due to the gap "G", the cleaning tool 32 can be inserted in the guide members 11 without an interference between the edge 32E and the guide members 11, which is favorable from the viewpoint of the operation of the cleaning tool 32. Furthermore, a contact pressure of the cleaning member 32A to the top surface 8*a*1 of the dust-proof glass 8*a* can be adjusted by setting a gradient of inflection of the inflection portion 32R.

Figure 14A:
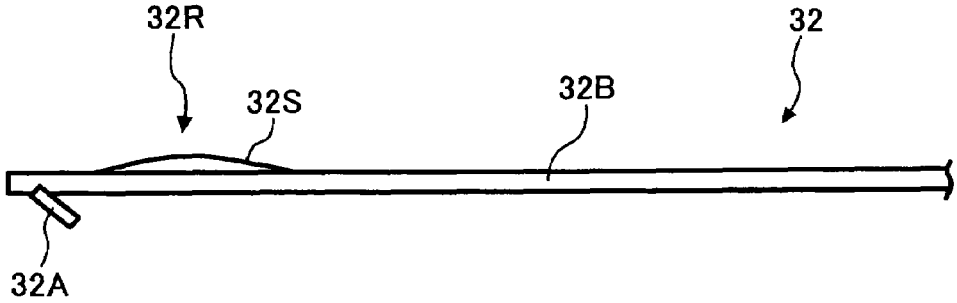
FIG. 14A is a schematic sectional view of another cleaning tool having an inflection portion.
Figure 14B:
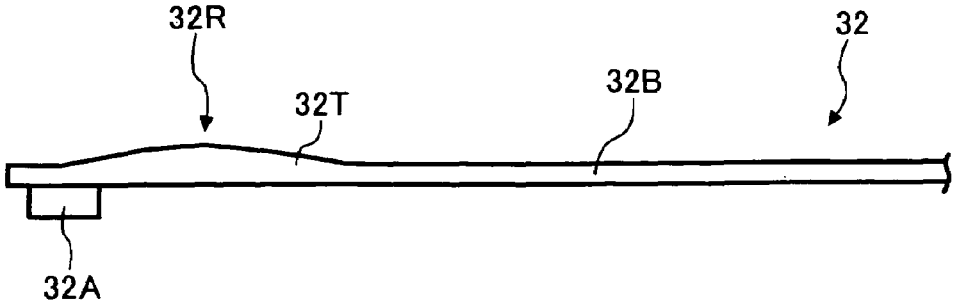
FIG. 14B is a schematic sectional view of another cleaning tool having an inflection portion.

FIGS. 14A and 14B show modified support members 32B. FIG. 14A show a modified support member 32B having an inflection portion 32R formed of flat spring 32S, and FIG. 14B show another modified support member 32B having inflection portion 32R formed of a convex-portion 32T which is integrated to the support member 32B.

FIG. 14B shows a cleaning tool including a cleaning member 32A formed of brush, felt, or sponge instead of the blade. Although the cleaning tool 32 shown in FIG. 14A employs a blade type for the cleaning member 32A, other types such as brush, felt, or sponge can be used for the cleaning member 32A. Similarly, although the cleaning tool 32 shown in FIG. 14B employs a brush type, felt type, or sponge type for the cleaning member 32A, a blade type can be used for the cleaning member 32A.

The flat spring 32S shown in FIG. 14A has a gradient of inflection, which is similar to that of the inflection portion 32R shown in FIGS. 13A, 13B, and 13C. With such a gradient of inflection, the support member 32B shown in FIG. 14A can attain a similar function of the support member 32B shown in FIGS. 13A, 13B, and 13C.

Similar to FIG. 14A, FIG. 14B shows another support member 32B having the convex-portion 32T of arc-shape. Whenever the convex-portion 32T passes through the guide members 11, a predetermined contact pressure is applied to the cleaning member 32A to conduct an effective cleaning on the dust-proof glass 8*a*.

Numerous additional modifications and variations are possible in light of the above teachings. It is therefore to be understood that within the scope of the appended claims, the disclosure of the present invention may be practiced otherwise than as specifically described herein.

The invention claimed is:

1. An optical writing unit for use in an image forming apparatus, the optical writing unit comprising:

an optical system configured to generate a light beam to write an electrostatic latent image on an image carrying member of the image forming apparatus;

a casing configured to encase the optical system, comprising, an opening portion, and a transparent member configured to externally seal the opening portion, and including a top surface higher than a surface of the casing with a predetermined height and an optical writing area through which the light beam emits; and a cleaning tool including a cleaning member, a support member, and a handling part;

wherein the casing further includes a plurality of guide members configured to guide the cleaning tool during a cleaning operation, and the support member includes a portion which contacts at least one of the plurality of guide members while a first end portion of the support member is contact free with respect to the plurality of guide members when the cleaning tool conducts the cleaning operation.

2. The optical writing unit according to claim 1, wherein the top surface of the transparent member faces the image carrying member in an upward-direction.

3. The optical writing unit according to claim 1, wherein the cleaning tool is configured to clean off the top surface of the transparent member.

4. The optical writing unit according to claim 3, wherein the support member further includes a second end portion opposite the first end portion, and the first end portion is attached to the cleaning member and the second end portion is attached to the handling part.

5. The optical writing unit according to claim 4, wherein the support member includes an inflection portion between the first and second end portions of the support member.

6. The optical writing unit according to claim 5, wherein the inflection portion is situated at a highest point along the support member in comparison with heights of the first and second end portions of the support member relative to the top surface of the transparent member.

7. The optical writing unit according to claim 3, wherein (a) a width of the cleaning member is smaller than a width of the transparent member, and larger than a width of the opening portion, and (b) each of the width of the cleaning member, the transparent member, and the opening portion is perpendicular to a longitudinal direction of the transparent member.

8. The optical writing unit according to claim 5, wherein the inflection portion is integrally formed on the support member with an arc shape.

9. The optical writing unit according to claim 5, wherein the inflection portion is formed by a flat spring.

10. The optical writing unit according to claim 1, wherein the cleaning tool is configured to remove a deposit adhered on the top surface of the transparent member with the cleaning member which is contactingly moved on the top surface of the transparent member using the plurality of guide members for guidance.

11. The optical writing unit according to claim 10, wherein the cleaning member includes a blade having an edge portion configured to contact the top surface of the transparent member to remove the deposit adhered to the top surface of the transparent member.

12. The optical writing unit according to claim 1, wherein (a) the opening portion is surroundingly provided with a recessed area having a predetermined depth from the surface of the casing to receive the transparent member to seal the opening portion, and (b) a height of the transparent member and a height of the surface of the casing satisfy a relationship $0<X<t$, wherein X represents a predetermined height of the top surface of the transparent member from the surface of the casing, and t represents a thickness of the transparent member.

13. The optical writing unit according to claim 12, wherein the casing further comprises a position regulator configured to regulate a position of the cleaning tool to place the cleaning member at a start point of the cleaning operation by the cleaning tool.

14. The optical writing unit according to claim 13, wherein the position regulator regulates the start point of the cleaning operation between a rear side of the transparent member, from which the cleaning tool starts the cleaning operation, and an end of the optical writing area, which is closest to the rear side of the transparent member.

15. The optical writing unit according to claim 1, wherein the opening portion is surroundingly provided with an attachment area having a predetermined height from the surface of the casing to receive the transparent member to seal the opening portion.

16. The optical writing unit according to claim 15, wherein the casing further comprises a position regulator configured to regulate a position of the cleaning tool to place the cleaning member at a start point of the cleaning operation by the cleaning tool.

17. The optical writing unit according to claim 16, wherein the position regulator regulates the start point of the cleaning operation between a rear side of the transparent member, from which the cleaning tool starts the cleaning operation, and an end of the optical writing area, which is closest to the rear side of the transparent member.

18. The optical writing unit according to claim 1, wherein (a) the transparent member includes a front side from which the cleaning tool enters the top surface of the transparent member, and a rear side from which the cleaning tool starts a cleaning operation, and (b) a height of the surface of the casing which faces the rear side of the transparent member and a height of the top surface of the transparent member at the rear side satisfy a relationship $X \leqq 0$, wherein X represents a predetermined height of the top surface of the transparent member measured from the surface of the casing at the rear side of the transparent member.

19. An optical writing unit for use in an image forming apparatus, the optical writing unit comprising:

means for generating a light beam to write an electrostatic latent image on an image carrying member of the image forming apparatus; and means for encasing the means for generating, comprising, an opening portion, and means for externally sealing the opening portion and including a top surface higher than a surface of the means for encasing with a predetermined height and an optical writing area through which the light beam emits; and means for cleaning including a cleaning member, means for supporting the cleaning member, and a handling part;

wherein the means for encasing further includes a plurality of means for guiding the means for cleaning during a cleaning operation, and the means for supporting the cleaning member includes a portion which contacts at least one of the plurality of means for guiding while a first end portion of the means for supporting is contact free with respect to the plurality of means for guiding when the means for cleaning conducts the cleaning operation.

20. An image forming apparatus, comprising:

an image forming unit including an image carrying member and a developing unit configured to develop an electrostatic latent image as a toner image; and an optical writing unit, comprising, an optical system configured to generate a light beam to write an electrostatic latent image on an image carrying member of the image forming apparatus, and a casing configured to encase the optical system, comprising, an opening portion, and a transparent member configured to externally seal the opening portion, and including a top surface higher than a surface of the casing with a predetermined height and an optical writing area through which the light emits, and a cleaning tool including a cleaning member, a support member, and a handling part;

wherein the casing further includes a plurality of guide members configured to guide the cleaning tool during a cleaning operation, and the support member includes a portion which contacts at least one of the plurality of guide members while a first end portion of the support member is contact free with respect to the plurality of guide members when the cleaning tool conducts the cleaning operation.

21. The image forming apparatus according to claim 20, wherein the optical writing unit is provided under the image forming unit.

22. The image forming apparatus according to claim 20, wherein the opening portion is surroundingly provided with a recessed area having a predetermined depth from the surface of the casing to receive the transparent member to seal the opening portion.

23. The image forming apparatus according to claim 20, wherein the opening portion is surroundingly provided with an attachment area having a predetermined height from the surface of the casing to receive the transparent member to seal the opening portion.

24. An optical writing unit for use in an image forming apparatus, the optical writing unit comprising:

an optical system configured to generate a light beam to write an electrostatic latent image on an image carrying member of the image forming apparatus;

a casing configured to encase the optical system, comprising, an opening portion, and a transparent member configured to externally seal the opening portion, and including a top surface higher than a surface of the casing with a predetermined height and an optical writing area through which the light beam emits; and a cleaning tool including a cleaning member, a support member, and a handling part;

wherein the support member includes an inflection portion between first and second end portions of the support member, the first end portion is attached to the cleaning member and the second end portion is attached to the handling part, and the inflection portion is formed by a spring.

* * * * *